US005926858A

United States Patent [19]

Heller

[11] Patent Number: 5,926,858

[45] Date of Patent: Jul. 27, 1999

[54] PORTABLE MALE URINAL ASSEMBLY AND ASSOCIATED STABILIZER

[76] Inventor: Thomas G. Heller, 500 Hoodridge Dr., Pittsburgh, Pa. 15234

[21] Appl. No.: 09/139,505

[22] Filed: Aug. 25, 1998

Related U.S. Application Data

[63] Continuation-in-part of application No. 08/799,699, Feb. 11, 1997, abandoned.

[51] Int. Cl.[6] ..... A47K 11/00

[52] U.S. Cl. ..... 4/144.1; 4/144.3

[58] Field of Search ..... 4/144.1, 144.2, 4/144.3, 144.4, 114.1, 450, 454, 457

*Primary Examiner*—David J. Walczak
*Attorney, Agent, or Firm*—David W. Brownlee; Arnold B. Silverman; Eckert Seamans Cherin & Mellott, LLC

[57] ABSTRACT

A portable male urinal has a hollow urinal body with an inlet in communication with a reservoir. The urinal body has a flat stabilizer on the bottom of the reservoir having a greater width than the width of the adjacent urinal body and structured to underlie the legs of a male patient lying on his back.

The stabilizer base preferably has a generally flat undersurface and a pair of spaced urinal body engaging walls projecting upwardly therefrom. The stabilizer base preferably has an undersurface which contains friction enhancing material. The stabilizer may have a top wall connecting the sidewalls and an end wall. A handle may be provided on the stabilizer to facilitate removal of the stabilizer from the urinal. In one embodiment, the stabilizer is secured to the urinal by friction. In another embodiment mechanical securement above and beyond frictional retention is provided. A drainage outlet may be provided with the reservoir floor sloping toward the same to facilitate gravity flow of urine to the outlet for discharge.

28 Claims, 5 Drawing Sheets

PORTABLE MALE URINAL ASSEMBLY AND ASSOCIATED STABILIZER

CROSS-REFERENCE TO RELATED APPLICATION

This is a continuation-in-part of U.S. patent application Ser. No. 08/799,699, filed Feb. 11, 1997, now abandon.

BACKGROUND OF THE INVENTION

1. Field of the Invention

The present invention relates to a portable male urinal of the type used by males who are confined to bed and, more specifically, relates to an assembly which contains a stabilizer which resists tipping over of the urinal with resultant spillage of urine.

2. Description of the Prior Art

It has been known with respect to patients who are temporarily or permanently bedridden to provide apparatus which facilitates a patient urinating or defecating while remaining in bed.

U.S. Pat. Nos. 3,453,664, 3,846,849, 4,136,798, 4,827,540, and 5,394,571 are examples of bedpans which have been used for many decades for such purposes.

It has also been known to use internal catheters to assist patients with urination. These catheters have one end inserted into the patient and the other end connected by suitable tubing to a collection bag. Among the problems encountered with such catheters are if they are left in for a significant period of time, there is not only patient discomfort, but a risk of infection.

It has also been known to use external catheters which reduce the risk of infection, but may nevertheless result in soreness. A physician's prescription is required for both the internal catheter and external catheter.

It has been known to provide a male catheter which is generally a unitary member having an angularly disposed elongated passageway into which the patient urinates. The passageway communicates with a urinal reservoir. See, generally, U.S. Pat. Nos. 1,440,765, 1,767,240, 2,358,850, 2,594,339 and 4,270,231. The top is generally angularly upwardly sloped and the base is generally flat.

As shown in U.S. Pat. Nos. 1,440,765, 1,767,240, 2,358,850 and 4,270,231, a drain having a suitable closure may be employed to facilitate emptying of the urinal. It has also been known to provide the urinal with a drain outlet which delivers the urine a suitable collection container. See, for example, U.S. Pat. Nos. 1,440,765, 2,594,339 and 4,117,845.

In spite of the foregoing known systems, there remains a very real and substantial need for an improved male portable urinal assembly which will resist undesired tipping of the urinal which is not only a health hazard and requires a change in the bedding, but also has an emotional impact on the patient. There is also a need for such a system which may be retrofit into existing male urinals which do not have such stabilizing features.

SUMMARY OF THE INVENTION

The present invention has solved the above-described problems by providing a portable male urinal which has a hollow urinal body, having a urine inlet and a urine receiving reservoir. A stabilizer is secured to a portion of the urinal body adjacent to the reservoir with the stabilizer portion underlying the reservoir having a width greater than the width of the adjacent urinal body and preferably having a flat undersurface.

The stabilizer preferably has a pair of upwardly projecting spaced urinal body engaging walls and may have flanges or a top wall engaging the upper surface of the urinal.

The stabilizer may also have a handle to facilitate securement to and removal of the urinal from the stabilizer.

Another feature of the invention is to provide a urinal which has a drainage outlet to which a tube connected with a collection bag may be secured. In one embodiment, the discharge outlet is at the distal end of the urinal from the inlet spout and the reservoir has a sloping bottom wall which causes urine to float toward the drain under the influence of gravity.

It is an object of the present invention to provide an improved portable male urinal assembly which resists undesired spillage through tipping over of the urinal.

It is a further object of the present invention to provide stabilizer means for a portable male urinal which may be retrofit into existing portable male urinals.

It is a further object of the present invention to provide such a stabilizer which has handle means to facilitate securement of the same to the urinal and removal therefrom.

It is another object of the present invention to provide such a stabilizer which readily may be secured to a urinal by friction means or other mechanical means, such as one creating a snap fit relationship.

It is a further object of the present invention to provide such a stabilizing system which is compatible with an integral drainage system for the urinal.

These and other objects of the invention will be more fully understood from the following description of the invention with reference to the drawings appended hereto.

DESCRIPTION OF THE PREFERRED EMBODIMENTS

Figure 1:
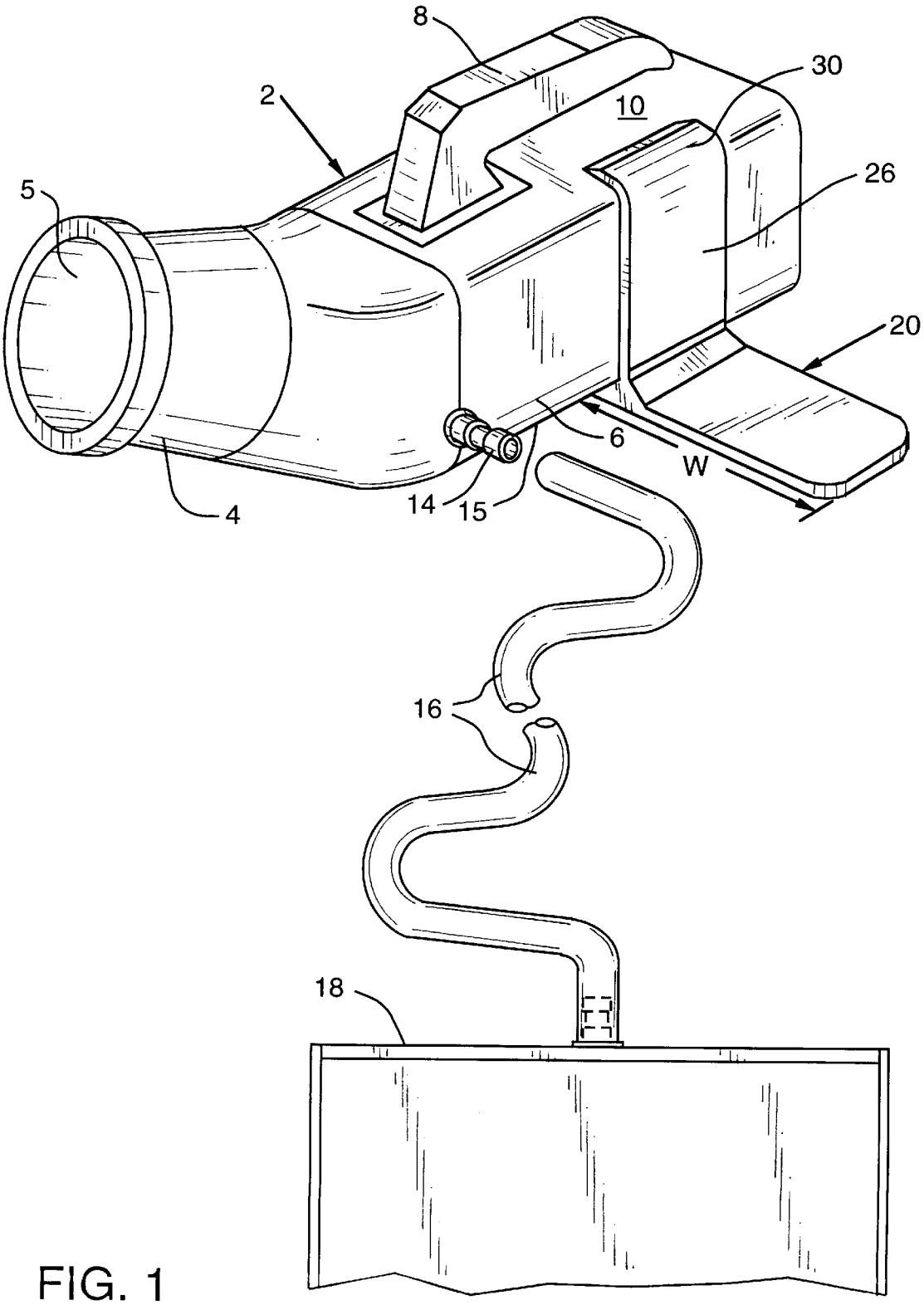
FIG. 1 is a partially exploded perspective view of a male urinal having some of the features of the present invention.
Figure 2:
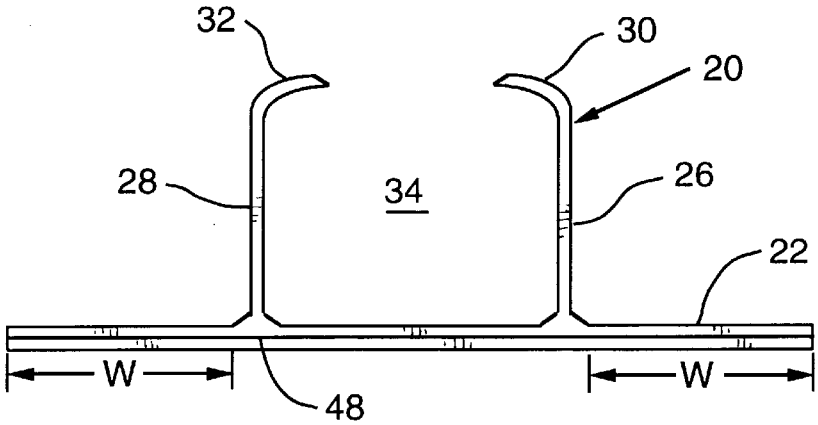
FIG. 2 is a front elevational view of the stabilizer shown in FIG. 1.

Referring to FIGS. 1 and 2, there is shown a male urinal 2 which may except for the presence of the drain to be discussed hereinafter, be a conventional type of urinal which has been unitarily molded from a resinous plastic material to create a substantially rigid structure. The urinal is preferably elongated and dimensioned to fit between the legs of a male patient lying in bed on his back. It has an angularly upwardly disposed and forwardly extending spout 4 which defines an inlet opening 5 for receipt of urine from the user. As used herein, "forwardly extending" means extending from an end of the urinal so the urinal can be positioned with the spout directed at an upward angle toward the patient for receipt of urine. The spout 4 is in communication with a reservoir portion 6 where urine is received. A handle 8 is disposed on the upper wall 10 of the urinal.

The elongated urinal 2, in a preferred embodiment of the invention, has a drainage outlet 14 connected to the urinal 2 at a position such that the central longitudinal axis of the drainage outlet 14 is disposed closer to the lower portion of the urinal 15 than to upper wall 10. The drainage outlet 14 is preferably sealingly connected by suitable tubing 16 to a closed receiving container 18. It will be appreciated that in this manner, rather than risking undesired spillage of urine onto the bed as a result of overflow of the urinal, the drainage outlet serves to provide a means for withdrawing the urinal to a suitable container which can be emptied periodically. The container will generally have a greater fluid capacity than the urinal.

The urinal is provided with a flat lower surface so as to permit it to lie flat on a bed or other patient supporting surface. Part of the difficulty, however, is that bed ridden patients with minimal movement, that may be made either while the patient is awake or asleep, tend to periodically inadvertently knock over the urinal thereby creating spillage.

In the form of stabilizer 20 of the present invention shown in FIGS. 1 and 2, the assembly may be created as an integral part of the original product or the stabilizer may be detachably secured by retrofitting it to the urinal. The stabilizer may be molded into a substantially rigid unit from a suitable resinous plastic material. "Substantially rigid" is used to mean that the plastic is self-supporting so as to maintain its shape but has some flexibility or is resiliently deflectable enough to allow some flex in the wing-like projections or wings described below, similar to the manner in which plastic credit cards and other solidly molded plastic articles maintain their shape. The molded plastic of the stabilizer is preferably solid material (not hollow but may contain gas bubbles) and is non-inflatable. In the form shown, the stabilizer has an elongated base 22 which is substantially flat and a pair of upstanding thin sidewalls 26, 28 which terminate at their upper extremity in transversely inwardly projecting flanges 30, 32. It is contemplated that depending upon the size of flanges 30, 32, the assembly may be created by end-to-end sliding of the stabilizer over the end which is distal with respect to the inlet 5, or by snap-fitting the same. In either event, the urinal will be secured within recess 34. The securement of the stabilizer 20 to the urinal 2 may be retained by frictional interengagement between the two with or without enhanced retention due to resiliency of walls 26, 28.

As indicated in FIGS. 1 and 2, the stabilizer base 22, which underlies the reservoir 6, has a width which exceeds the exterior width at the reservoir 6 at that location by 2 W. The base 22 extends outwardly from under the bottom wall of the reservoir portion 6 of the urinal to provide wing-like projections at the locations 2 W on opposite sides of the urinal. The projections or wings are thin and generally flat so they can underlie a patient's legs for extended periods without discomfort to the patient. This provides substantially enhanced resistance to undesired tipping over of the urinal. It will be appreciated that the elongated urinal will tend to resist tipping in an axial longitudinal direction of the urinal as a result of the length of the urinal and will tend to resist tipping in a transverse direction or angularly transverse direction due to the stabilizer 20. It is preferred that the excess width W on each side of the stabilizer would be a minimum of about 3.5 inches and preferably would be about 3.5 to 16 inches. The projecting portions of the stabilizer (within region W) may have a depth measured parallel to the side and bottom walls of the reservoir portion 6 that is preferably less than about one-half the length of the reservoir, and more preferably about 1.5 to 3 inches, for example. If desired, a friction enhancing material 48, which may be a continuous web, may be secured to the stabilizer base 22.

Figure 3:
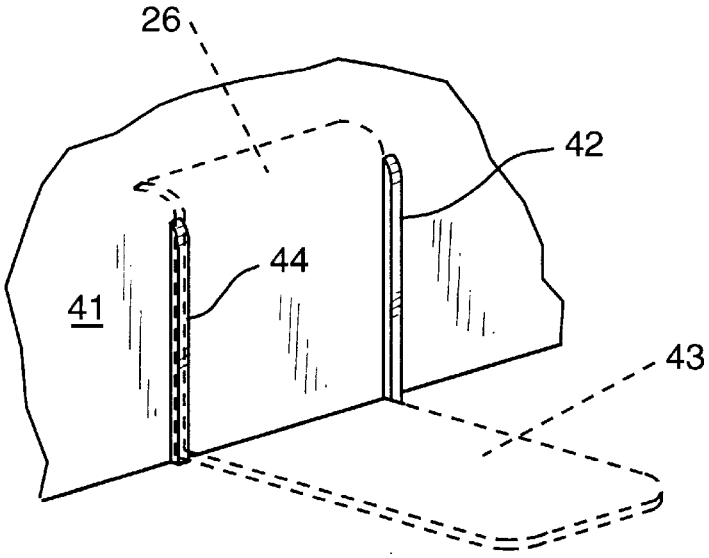
FIG. 3 is a fragmentary partially schematic illustration of a portion of the urinal and the associated means for securing the stabilizer thereto.

Referring to FIG. 3, another means for enhancing securement of the stabilizer will be considered. In this embodiment, the urinal, which is shown in fragmentary fashion, has a pair of integrally formed outwardly projecting ribs 42, 44 extending outward from wall 41 over which the stabilizer 43 may be snap fit through relative axial sliding movement of the urinal through recess 34, with the ribs 42, 44 serving to retain the stabilizer in the desired position. The ribs will be of such height that the sidewalls 26, 28 can resiliently deform outwardly as the stabilizer 20 is moved in position and serves as a physical obstruction to relative sliding movement without flexing of the sidewalls such as 26. Rather than being of generally uniform thickness, as shown in FIG. 3, the ribs 42, 44 may have a taper to provide a slightly greater thickness toward wall 41.

Figure 4:
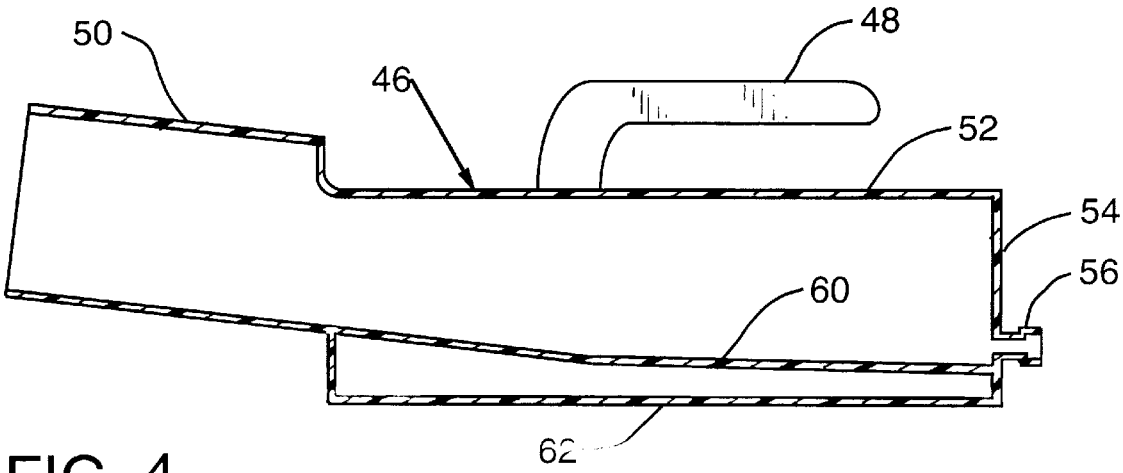
FIG. 4 is a cross-sectional illustration showing a modified form of the urinal of FIG. 1.

Referring to FIG. 4, another feature of the invention will be considered. In this embodiment a urinal 46 which has an inlet receiving spout 50 and a reservoir 52 in communication therewith has a flat base wall 62 and a handle 48. Disposed at the distal end, wall 54 is a drainage outlet. In order to efficiently deliver the urine from the inlet spout 50 to the discharge outlet 56, under the influence of gravity, bottom partition wall 60 over which the urine will flow, slopes toward the discharge outlet 56.

Figure 5:
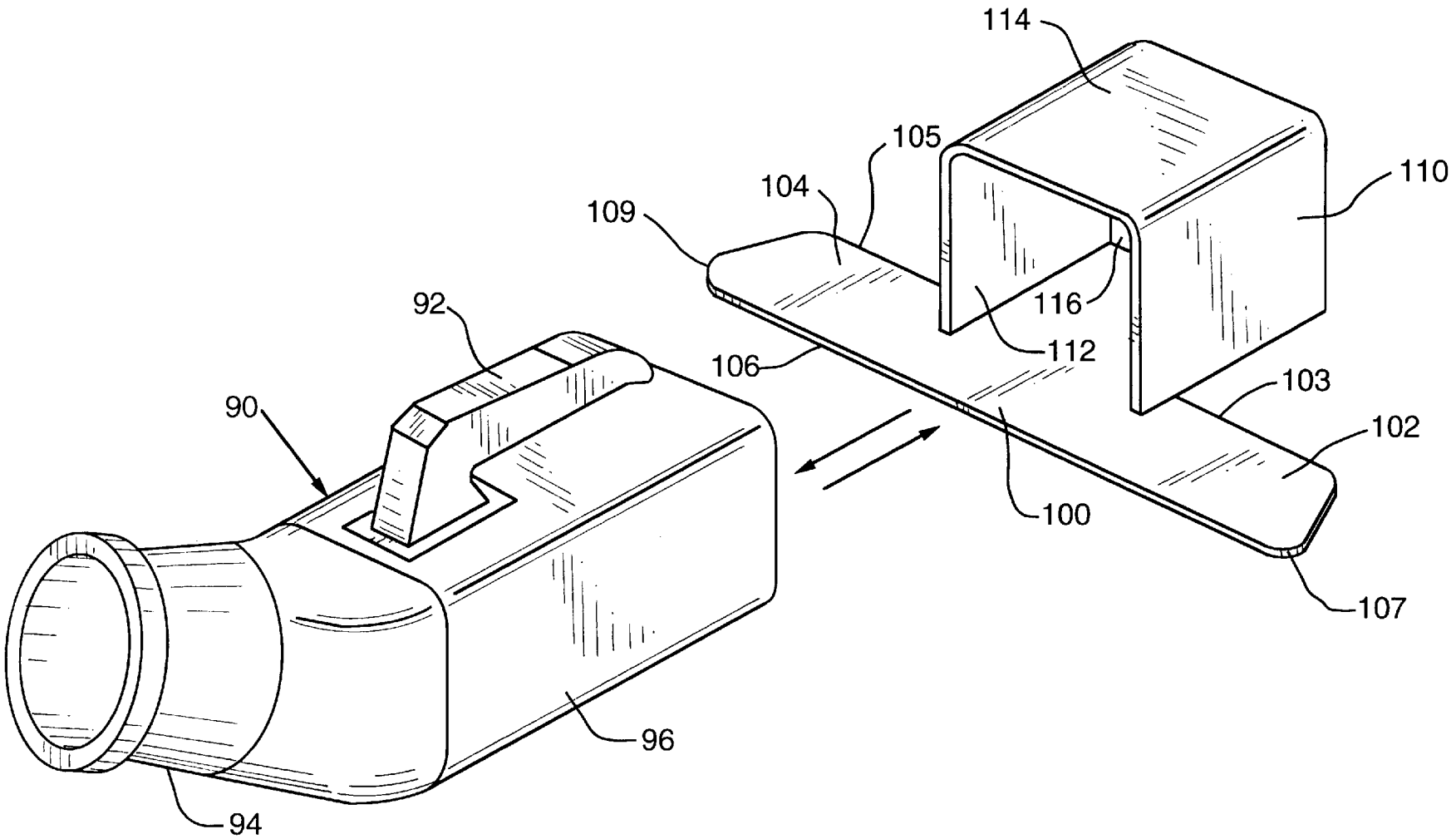
FIG. 5 is an exploded view of a prior art male urinal and another embodiment of the stabilizer of the present invention.
Figure 6:
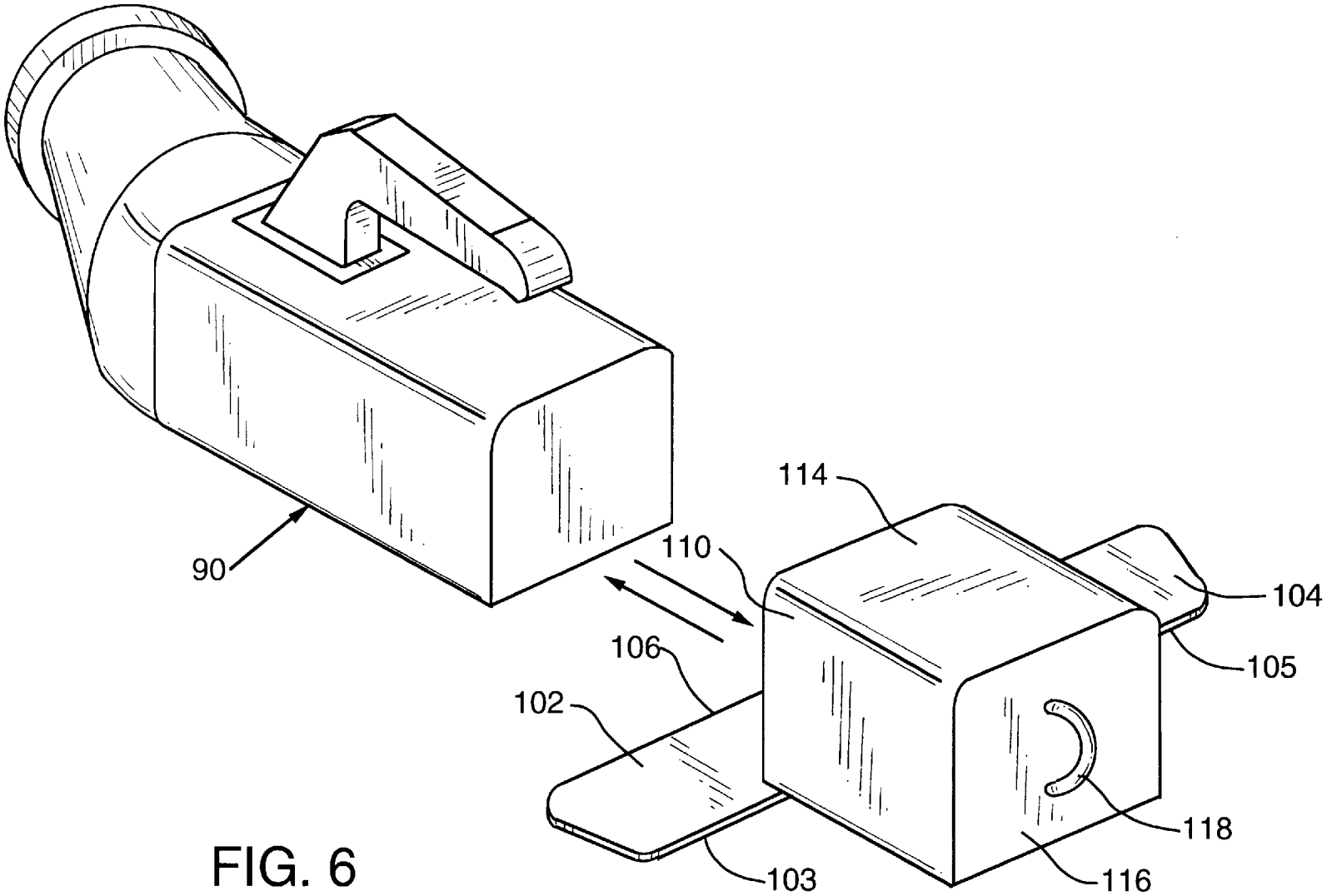
FIG. 6 is an exploded view of the urinal and stabilizer of FIG. 5 shown from another direction.

Referring to FIGS. 5 and 6, another embodiment of the invention will be considered. A conventional prior art portable urinal 90 which may be provided with a discharge outlet of the present invention not shown in these views. The urinal 90 has a handle 92, an inlet spout 94, and a cooperating reservoir 96. In the form of stabilizer shown in FIGS. 4 and 5, the stabilizer has a base portion 100 which is adapted to underlie the urinal reservoir 96 when it is assembled with a urinal 90. The forward edge 106 of the flat base portion 100 and the rearward portion of the base 100 are such that segments projecting sections 102, 104 will project farther along the forward edge 106 than along the rearward portions 103, 105, thereby creating angular edges 107, 109. In measuring width W (FIG. 2) of this embodiment, the maximum width measured along edge 106 would be employed.

In this embodiment of the invention, the sidewalls 110, 112 merge into a top wall 114 and an end wall 116. The rear wall 116 is provided with a loop handle 118 which will facilitate insertion of the stabilizer onto the urinal and removal of the same therefrom. It will be appreciated that the handle 118 may be positioned at other locations if desired. It is further noted that the top wall 114 will slide under handle 92 when the assembly is created.

Figure 7:
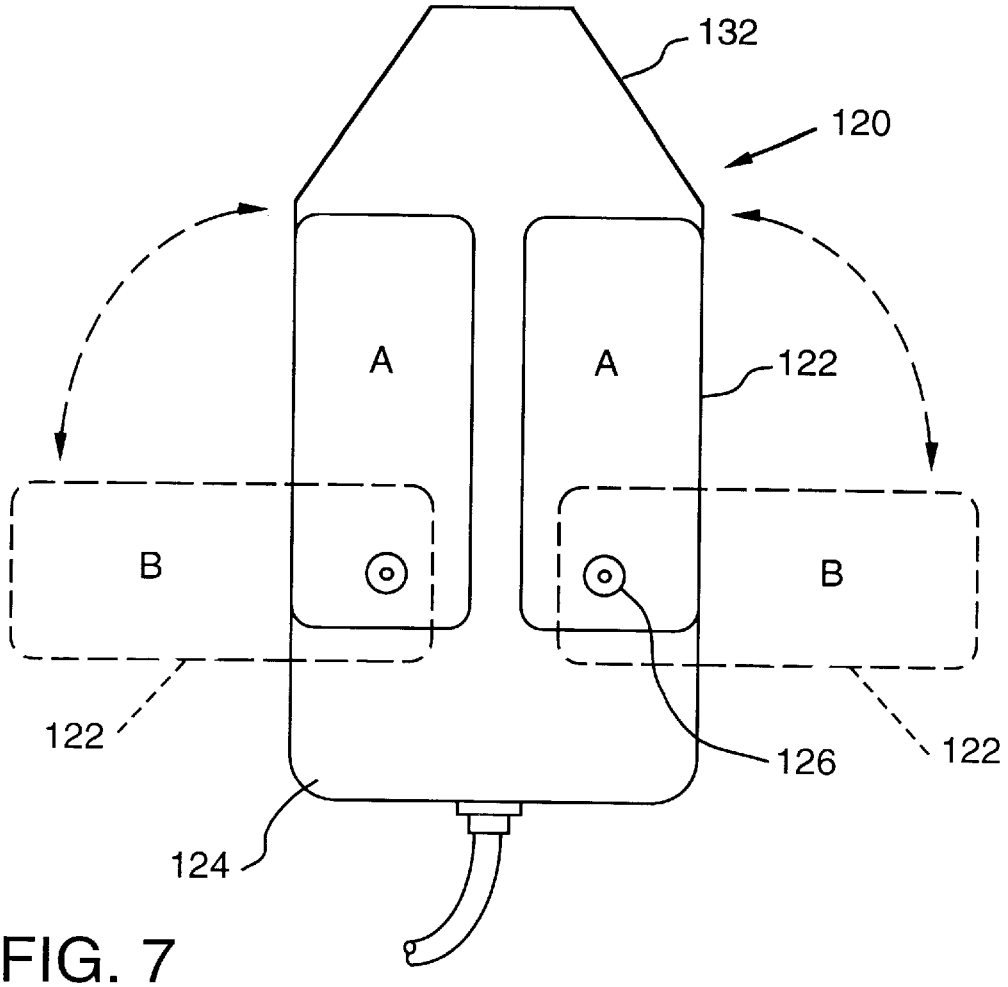
FIG. 7 is a bottom plan view of an alternative embodiment of the present invention.

FIG. 7 shows another embodiment of the invention in which a male urinal 120 has a stabilizer comprising a pair of wings 122 rotatably secured to the bottom wall 124 of the urinal. The wings 122 can be rotated from a non-functioning position A completely under the urinal to a functioning position B projecting laterally from opposite sides of the urinal. The wings 122 can be rotatably secured to the bottom wall 124 by a variety of means such as pins 126 on the bottom wall snap-fitted into holes in the wings. The wings 122 are substantially flat as in the other embodiments of this invention so as to comfortably underlie a patient's legs. The urinal 120 and/or wings 122 preferably include means, not shown, for locking the wings in positions A and B. Such locking means may comprise ribs or the like on the urinal which have a snap type engagement with the wings 122. The urinal 120 of FIG. 7 has a spout 132, shown in part, similar to the spout on the urinal of FIG. 1 and preferably has a drainage outlet 134 similar to the one shown in FIG. 4.

Figure 8:
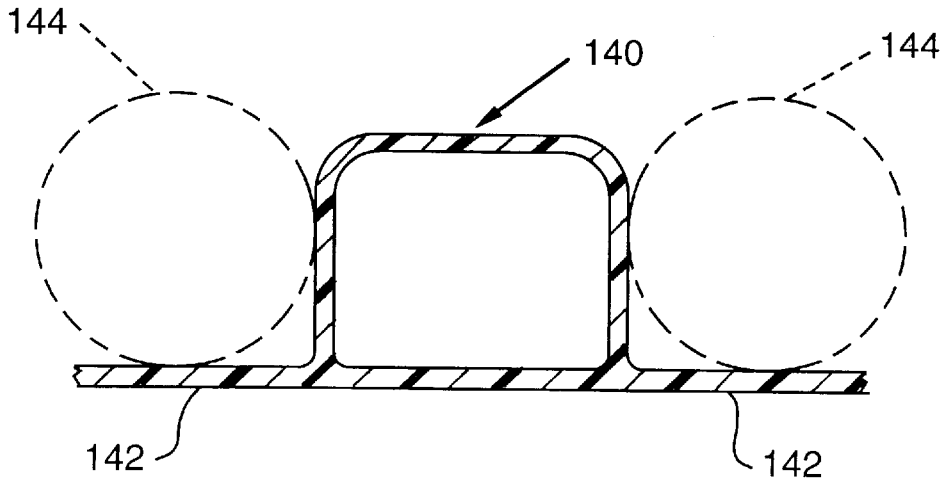
FIG. 8 is a cross-section through another alternative embodiment of the present invention.

FIG. 8 shows still another embodiment of this invention in which the urinal 140 has a stabilizer in the form of a pair of wings 142 integrally molded with the urinal. The wings 142 are preferably about the same size and shape as the outward projections on the stabilizer 20 of FIGS. 1 and 2. The urinal 140 has a spout, not shown, like the spout of FIG. 1 and preferably has a drain outlet similar to those shown in FIGS. 1 and 4. Like the wing-like projections or wings in the other figures, wings 142 are substantially flat and relatively thin so they will underlie a patient's legs 144 with little or no discomfort to the patient. The legs of a patient are ghosted in FIG. 8 and designed as 144.

It will be appreciated, therefore, that the present invention provides an effective means for providing a portable male urinal which eliminates the undesired spillage and related risks of the prior art systems in an economical and efficient manner which is adapted for either use in the original assembly or in retrofitting into existing male urinals.

While for convenience of disclosure herein specific reference has been made to the preferred use of a unitary molded resinous plastic material, it will be appreciated that the invention may be made out of other materials, such as stainless steel or aluminum, for example, if desired. If the stabilizer is made from a resinous plastic, the base is preferably resiliently deformable so as to facilitate its conforming to an underlying support surface.

Whereas particular embodiments of the invention have been described herein for purposes of illustration, it will be evident to those skilled in the art that numerous variations of the details may be made without departing from the invention as defined in the present claims.

I claim:

1. A portable male urinal structured to be positioned between the legs of a male patient lying on his back, comprising a hollow urinal body having an angularly upwardly and forwardly extending spout portion with an inlet in communication with a urine receiving reservoir, a non-inflatable, substantially rigid stabilizer secured to a portion of said reservoir, and said stabilizer having a base portion underlying said reservoir and having a width greater than the width of the adjacent portion of said urinal body with lateral projecting portions of said base structured to comfortably underlie said patient's legs for extended periods of time to resist tipping of the urinal.

2. The portable male urinal of claim 1 including said base of said stabilizer having a generally flat undersurface and a pair of spaced urinal body engaging, thin walls projecting upwardly from said base.

3. The portable male urinal of claim 2 including said stabilizer urinal body engaging walls having generally transversely inwardly directed end portions for overlying a portion of said reservoir.

4. The portable male urinal of claim 2 including said stabilizer being composed of a solidly molded, resinous plastic material.

5. The portable male urinal of claim 2 including said stabilizer being detachably secured to said urinal body by friction fit.

6. The portable male urinal of claim 2 including said urinal body having a top surface and side surfaces and a pair of outwardly projecting ribs on both sides of said reservoir which engage said urinal body engaging walls to resist undesired movement of said stabilizer with respect to said urinal body.

7. The portable male urinal of claim 2 including said urinal body being elongated, a handle projecting upwardly from the top of said reservoir on said urinal body, and said stabilizer being secured to said urinal body rearwardly of where the said handle is secured to said urinal body and extending for less than one-half the length of said reservoir.

8. The portable male urinal of claim 2 including friction enhancing means disposed on said undersurface of said stabilizer base.

9. The portable male urinal of claim 1 including a drainage outlet projecting outwardly from said urinal body and being in communication with said urinal reservoir, and said drainage outlet being disposed closer to the bottom of said reservoir than to the top of said reservoir, whereby a drainage tube may be secured to said drainage outlet and deliver urine therefrom to urine receiving means.

10. The portable male urinal of claim 9 including said urinal body having a top wall, a bottom wall, connecting lateral walls and an end wall disposed generally opposite said urine inlet.

11. The portable male urinal of claim 10 including said drainage outlet being disposed in a said lateral wall.

12. The portable male urinal of claim 10 including said drainage outlet being disposed in said end wall.

13. The portable male urinal of claim 1 including said urinal body being elongated and having an end wall at an opposite end from said inlet.

14. The portable male urinal of claim 13 including a drainage outlet in communication with said end wall and projecting outwardly therefrom, and said urinal body having a reservoir base sloping toward said end wall, whereby urine entering said reservoir will flow under the influence of gravity towards said end wall.

15. The portable male urinal of claim 13 including said stabilizer having a stabilizer body which is structured to receive a portion of said urinal body, and said stabilizer having a handle for facilitating removal of said stabilizer from said urinal body.

16. The portable male urinal of claim 15 including said stabilizer base portion underlying said reservoir extending farther forwardly than the remainder of said stabilizer.

17. The portable male urinal of claim 16 including said stabilizer base portion having a forward portion which is of greater width than the rearward portion thereof.

18. The portable male urinal of claim 17 including said stabilizer defining a urinal body receiving chamber and wherein said handle is secured to said body.

19. A non-inflatable, substantially rigid stabilizer for detachable securement to an elongated portable male urinal having an angularly upwardly and forwardly extending spout portion with an entry inlet and a reservoir, said stabilizer comprising a generally flat base portion for underlying said reservoir of said urinal and including laterally projecting portions of greater width than the portion of said urinal under which said stabilizer will be secured, said laterally projecting portion being structured and dimensioned to comfortably underlie a patient's legs for extended periods to resist tipping of said urinal, and a pair of upstanding sidewalls for engaging the sides of said urinal.

20. The stabilizer of claim 19 including said stabilizer having a handle for facilitating removal of said stabilizer from said urinal body from said urinal.

21. The stabilizer of claim 20 including said stabilizer having a top wall connected to said sidewalls, and said stabilizer having an end wall connected to said sidewalls and said top wall.

22. The stabilizer of claim 21 including said base portion projecting farther forwardly than a forward portion of said sidewalls.

23. The stabilizer of claim 20 including said stabilizer being solidly molded as a unit from a resinous plastic material.

24. The stabilizer of claim 19 including said base portion having a width about 7 to 32 inches greater than the exterior width of said reservoir.

25. A portable male urinal made of solidly molded resinous plastic, which is structured and dimensioned to remain between the legs of a male patient lying on his back, comprising a hollow urinal body that includes a urine-receiving reservoir having a generally planar bottom wall, a top wall, substantially vertical side walls, an end wall and a spout portion in communication with said reservoir and projecting angularly upwardly and forwardly from said reservoir on the end thereof opposite said end wall, and a pair of substantially flat stabilizer wings on opposite sides of said reservoir projecting laterally outwardly from said bottom wall and structured to comfortably underlie a patient's legs for extended periods of time so as to resist tipping of said urinal.

26. The portable male urinal of claim 25 including a drainage outlet on said reservoir near said bottom wall of said reservoir.

27. The portable male urinal of claim 25 in which said stabilizer wings have a length along said urinal less than one-half the length of said reservoir and are disposed toward said end wall of said reservoir.

28. A substantially rigid stabilizer for securement to an elongated portable male urinal having a reservoir portion that has top, bottom and side walls and a spout portion extending angularly upwardly and forwardly from said reservoir, and having an entry inlet thereto, said stabilizer being solidly molded from resinous plastic material and comprising a generally flat base portion for underlying less than about one-half the length of said reservoir and including wing portions for extending laterally outwardly from under said bottom wall of said reservoir for at least about 3.5 inches beyond said side walls of said reservoir to comfortably underlie the legs of a male patient lying on his back with said urinal between his legs, said stabilizer further having a pair of upstanding side walls for engaging said side walls of said reservoir, and said stabilizer being structured to be secured on said reservoir by at least one of frictional engagement and snap interengagement of said upstanding side walls of said stabilizer with said urinal.

* * * * *